United States Patent [19]

Dunfee

[11] Patent Number: 4,686,726

[45] Date of Patent: Aug. 18, 1987

[54] WATERBED SHEET AND INSERT MEANS THEREFOR

[76] Inventor: David C. Dunfee, 11011 N. 47th Dr., Glendale, Ariz. 85304

[21] Appl. No.: 870,726

[22] Filed: Jun. 4, 1986

[51] Int. Cl.[4] ..... A47G 9/00; A47G 9/02

[52] U.S. Cl. ..... 5/485; 5/496; 5/498

[58] Field of Search ..... 5/485, 496–499; 24/72.5; 297/226

[56] References Cited

U.S. PATENT DOCUMENTS

| | | | |
|---|---|---|---|
| 1,327,824 | 1/1920 | Holland | 5/497 |
| 1,508,643 | 9/1924 | Brokaw | 5/498 |
| 3,996,633 | 12/1976 | Burke | 5/497 |
| 4,045,831 | 9/1977 | Clark | 5/497 |
| 4,400,836 | 8/1983 | Pelura | 24/72.5 |
| 4,520,518 | 6/1985 | Reaser | 24/72.5 |

FOREIGN PATENT DOCUMENTS

| | | | |
|---|---|---|---|
| 944180 | 12/1963 | United Kingdom | 297/226 |

*Primary Examiner*—Gary L. Smith
*Assistant Examiner*—Michael F. Trettel
*Attorney, Agent, or Firm*—Charles P. Padgett, Jr.

[57] ABSTRACT

A waterbed mattress sheet an insert, combination having waterbed sheet flaps defining pockets into which resilient, sheet-anchoring inserts can be placed, serving to secure the sheet over the waterbed mattress since the inserts conform in shape to the sides of the mattress and extend underneath the lower edge portions of mattress a short distance, being wedged between the matress and its support frame by the weight of the water in the waterbed mattress and any load placed thereon and being removably restrained in that position by the weight of the waterbed mattress and any load placed thereon against wrinkling, folding, creasing or slipping.

13 Claims, 7 Drawing Figures

FIG. 1
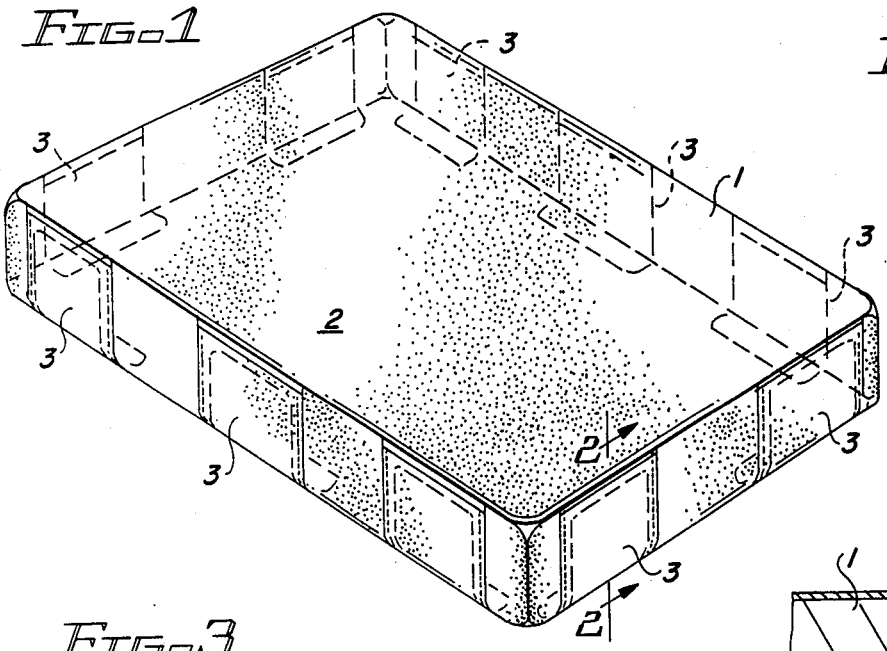
FIG. 5
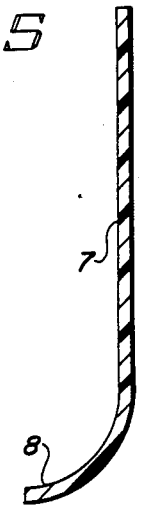
FIG. 3
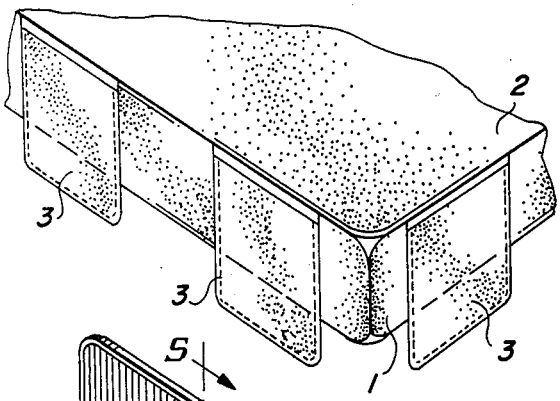
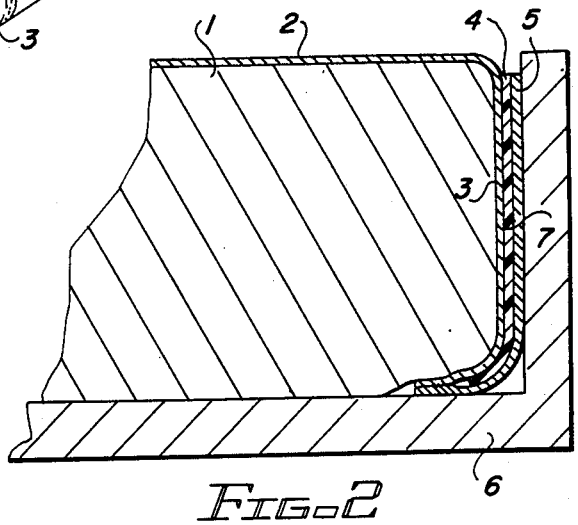
FIG. 2
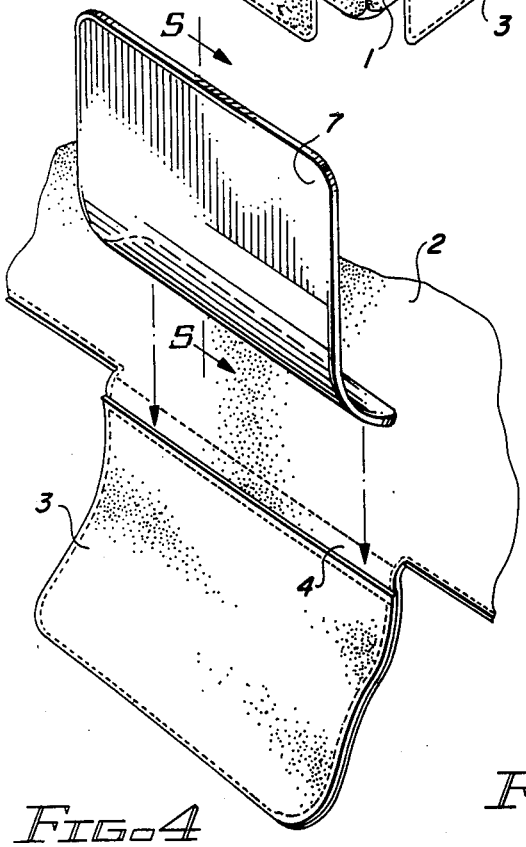
FIG. 4
FIG. 6
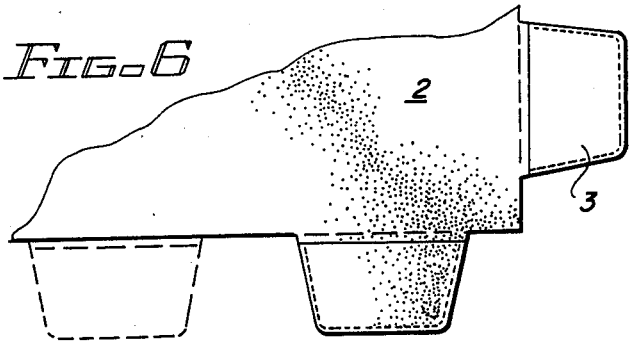
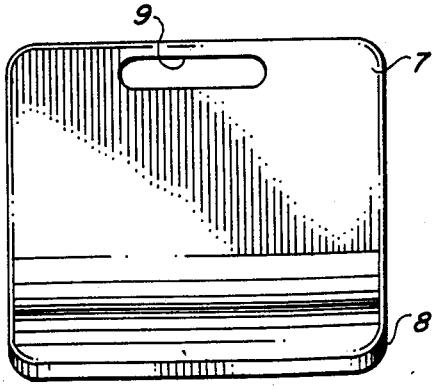
FIG. 7

WATERBED SHEET AND INSERT MEANS THEREFOR

BACKGROUND OF THE INVENTION

This invention relates to the combination of a sheet and sheet-anchoring apparatus for covering a bed mattress, especially a mattress for the type of bed which is commonly termed a waterbed, which is filled with water to provide support.

An object of this invention is to provide a cover sheet for a waterbed mattress with provisions for removeably anchoring or securing the sheet to the waterbed mattress so as to prevent slipping of the sheet off of the mattress, as well as uncomfortable folds and wrinkles.

SUMMARY OF THE INVENTION

A sheet is described for a waterbed mattress wherein the sheet has pocket-like flaps disposed at least near each of the four corners of the sheet so that those portions can be tucked and anchored under the mattress. Each flap has a pocket to receive an insert device which is shaped to generally conform to the shape of the outwardly bulging side of the waterbed mattress for anchoring the sheet.

BRIEF DESCRIPTION OF THE DRAWINGS

FIG. 1 is a perspective view of a waterbed mattress covered by a waterbed sheet utilizing the sheet-anchoring apparatus of the present invention;

FIG. 2 is a partial sectional view taken along view lines 2—2 of FIG. 1;

FIG. 3 is an enlargement of a portion of FIG. 1, showing the pockets without the inserts;

FIG. 4 is an enlargement of the pocket portion of FIG. 3 with an insert about to be installed or placed into a pocket;

FIG. 5 is a side view of one embodiment of the insert of the present invention;

FIG. 6 is an elevation of a portion of a waterbed sheet showing an alternate embodiment of the pockets; and FIG. 7 is a front view of the insert of FIG. 5.

DETAILED DESCRIPTION OF THE PREFERRED EMBODIMENT

The waterbed sheet and sheet-holding insert combination of the present invention is intended to cover the entire top surface of a waterbed mattress to protect it in the manner of a conventional bed sheet. The waterbed sheet has a plurality of pocket-forming flaps which are formed to removeably receive flap inserts therein. The insert-filled pocket flaps are tucked under the edges or undersides of the waterbed mattress of the mattress to hold the sheet securely in place and to prevent slippage, wrinkles, and folds.

A waterbed mattress normally has a box-like shape which approximately defines a rectangular solid with the corners and sides being somewhat rounded. For the purposes of this specification and the claims, the broad, flat top and bottom surfaces of the waterbed mattress are termed the "horizontal surfaces" while the smaller side and end surfaces, disposed along the thickness of the mattress, are termed the "vertical surfaces". The vertical surface may, and usually do, have an outward bulge or curvature.

The waterbed sheet covers the top or upper horizontal sleeping surface while the bottom or lower horizontal surface rests on a waterbed support frame.

Referring to FIG. 1, a waterbed mattress 1 is shown which has a waterbed sheet 2 covering its entire top horizontal surface. Sheet 2 has ten flaps 3 which are either an integral part of the sheet itself or separately stitched or sewn thereto, and which are located at spaced intervals around the perimeter of sheet 2 so as to extend vertically downwardly from the edges thereof.

Flaps 3 have a hollow sheath 5 of fabric or other material sewn or otherwise attached, thereby forming a pocket 4, as shown in FIG. 2. In FIG. 2, waterbed mattress 1 rests in a waterbed frame 6. Pockets 4 are adapted to receive a sheet-anchoring insert 7 which may be rigid or somewhat resilient or even pliable. FIGS. 4, 5 and 7 are views of a typical insert 7, showing a generally curved end portion or hook-shape 8 and an optional hand hold 9.

FIG. 3 also shows a waterbed sheet 2 laid flat on a waterbed mattress 1 with three flaps 3 defining empty pockets. FIG. 6 shows a portion of a waterbed sheet 2 with flaps 3, stretched flat. In FIG. 4, an insert is about to be inserted into pocket 4 of flap 3 with the inwardly curved hook-like end portion 8 directed under the edge of the bottom surface of the waterbed mattress 1.

When inserted into pocket 4, the inwardly curved portion of insert 7 conforms with the curvature of the outwardly bulged side or vertical surface of mattress 1 and forces the inwardly curved end of flap 3 under the lower horizontal surface of the waterbed mattress 1, and between the side of waterbed mattress 1 and the vertical frame member 6. Sheet 2 is secured by the weight of waterbed mattress 1 bearing on insert 7 within the pocket 3 and therethrough onto frame 6.

Inserts 7 may be of a variety of geometric shapes and materials, a pliable, spring-like resilient material such as resilient plastic being preferred. Insert 7 should have a relatively broad surface area.

Handhold 9 defines a human hand-sized hole or aperture in an upper end of insert 7.

It is intended that the inserts 7 have a shape which conforms generally to the outward curvature or bulge of the vertical surfaces of the mattress when unloaded. When a person occupies the bed, the added weight causes the mattress to deform or bulge outwardly, altering the shape of the vertical side and end surfaces. This deforming force is transmitted outwardly and downwardly to inserts 7 which, being pliable and even having a degree of spring tension, deform accordingly thereby transmitting part of the weight of the person on the waterbed to an additional force for holding or anchoring the waterbed sheet in place. The sheet is therefore held unwrinkled, smooth, and comfortable so that it won't bunch up, slide off, or become wrinkled.

While the present invention has been particularly described and illustrated with respect to the preferred embodiment of the present invention, it will be understood by those skilled in the art, that various changes, modifications, variations, substitutions, and alterations can be made in the structure, materials, dimensions, and the like, without departing from the spirit and scope of the present invention, which is limited only by the appended claims.

I claim:

1. A waterbed mattress-covering sheet assembly for protectively covering at least the sleeping surface of a waterbed mattress, said waterbed mattress having an upper horizontal sleeping surface, a lower horizontal surface adapted to be disposed on a waterbed frame, said waterbed frame having a bottom for supporting the weight of the water-filled mattress and frame sides for limiting the outward bulge of the side portions of the waterbed mattress at least when loaded, and peripheral side portions connecting the upper and lower horizontal surfaces, said peripheral side portions bulging outward from the center of the waterbed mattress in response to the weight of the water contained therein and any load placed thereon, said waterbed sheet assembly comprising, in combination:

a waterbed sheet of relatively flexible fabric material dimensioned to at least cover said upper sleeping surface of said waterbed mattress;

a plurality of pocket-forming flap means operatively disposed at predetermined spaced intervals about the edges of the waterbed sheet adjacent the peripheral edges of the upper sleeping surface of the waterbed mattress and depending downwardly therefrom, said flap means including means for forming pockets, each of said pockets including an upper open end portion, a bottom closed end portion, and an intermediate sheathlike hollow pocket portion integrally disposed therebetween, the upper end portion of each of said pockets being at least one of integral with and attached to said waterbed sheet; and insert means having an upper end portion, a generally planar intermediate portion, and a lower end portion curved outwardly away from the plane of said intermediate portion, each of said insert means being slideably received within one of said pockets such that said curved lower end portion is forced under the outer peripheral edge of the lower horizontal surface of the waterbed mattress and anchored in that position by the weight of the water contained within the waterbed mattress, and wherein said intermediate portion is clampably retained against a side of said waterbed frame by the outward bulge in the sides of the waterbed mattress caused by said weight, said anchored end portion and said clamped intermediate portion of said inserts sheathed within said pockets maintaining said waterbed sheet stretched tantly over said upper sleeping surface, without wrinkles, folds, creases, bunching up, and slippage of the sheet from the tucked position.

2. The sheet assembly of claim 1 wherein each of said inserts has a curved geometry which approximately matches the outwardly curved bulging surface of the sides of said waterbed mattress when no weight is applied to said horizontal sleeping surface such that the insertion of said inserts into said pockets forces said flaps to conform to the curved surfaces of said sides of said waterbed mattress, such that when the curved lower end portion of each of said inserts is disposed within one of said sheath-like pockets, and said flaps and inserted under the lower edge portions of said waterbed mattress, said inserts are captured by the weight of the water in said waterbed mattress bearing outwardly and downwardly on said flaps, thereby securing said waterbed sheet to said waterbed mattress, said inserts being flexible and including a generally resilient plastic material for bending to conform to the curved shape of the outward bulge of the sides of said waterbed mattress when additional weight, as from a human body, is placed on the upper horizontal sleeping surface thereof.

3. The sheet apparatus of claim 1 wherein said inserts have a curved geometry which approximately matches the curved surface of the outwardly bulging sides of said waterbed mattress such that the insertion of said inserts into said pockets forces said flaps to conform to the outwardly bulging curved surfaces of said sides of said waterbed mattress, said flaps being captured by the weight of the water in said waterbed mattress bearing outwardly on the intermediate portion thereof and downwardly on the curved lower end portion of said insert for securing said waterbed sheet to said waterbed mattress, each of said inserts including an opening means operatively disposed in said upper end portion thereof for enabling at least a portion of a person's hand to grip said opening means for inserting and removing said inserts into and out of said hollow sheath-like pockets.

4. A waterbed mattress-covering waterbed sheet and insert combination for protectively covering at least the top sleeping surface of a waterbed mattress whose bottom surface is adapted to be disposed on the bottom of a waterbed frame, said waterbed mattress including outwardly curved bulging sides integrally connecting said top and bottom horizontal surfaces, said waterbed frame including a bottom for supporting the weight of the waterbed mattress thereon and sides for limiting the distance of the outward bulge when the mattress is loaded, said waterbed sheet and insert combination comprising:

a waterbed sheet of relatively flexible fabric material dimensioned generally larger than the upper horizontal sleeping surface of the waterbed mattress such that the edge portions of said waterbed sheet are adapted and sized to hang substantially vertically downward to etend at least a predetermined length below the bottom surface of said waterbed mattress for being tucked thereunder to hold said waterbed sheet securely in place;

a plurality of sheath-like pockets each having an open upper end portion disposed adjacent the periphery of the waterbed mattress; an intermediate pocket-forming portion, and a closed lower end portion extending at least said predetermined length below the bottom surface of said waterbed mattress, said pockets extending generally vertically downward over the vertically disposed, downwardly hanging edge portions of said waterbed sheet;

a plurality of generally resilient pocket inserts each having an upper end portion, an intermediate portion, and a lower end portion curved away from said intermediate portion; and one of said pocket inserts being adapted to be slideably and removably received into each of said pockets such that the curved lower end portion is disposed proximate the closed lower end portion of said pocket and is slideably received under at least the outer peripheral edge portion of the bottom surface of the waterbed mattress and is anchored thereunder by the weight of the water in the unloaded waterbed mattress itself, and whereby the sides of the waterbed mattress bulge even further outwardly when loaded to removably clamp the intermediate portion of the pockets having said pocket inserts therein against the side of the bed frame to even more firmly and securely anchor the waterbed sheet to prevent its coming untucked.

5. The waterbed sheet and insert combination of claim 4 wherein each of said intermediate portions of said inserts including a resilient material means for generally conforming to the outward bulge in the sides of the waterbed mattress when the waterbed mattress is loaded.

6. The waterbed sheet and insert combination of claim 4 wherein each of said inserts is an integral sheet of resilient plastic material.

7. The waterbed sheet and insert combination of claim 6 wherein the upper end portion of each said inserts includes means for forming a handle aperture for manually inserting and removing said insert from said pocket.

8. The waterbed sheet assembly and insert combination of claim 4 wherein said sheath-like pockets are separately formed and fixedly secured to said waterbed sheet.

9. The waterbed sheet and insert combination of claim 4 wherein said sheath-like pockets are integrally formed with the formation of said waterbed sheet.

10. The waterbed sheet and insert combination of claim 4 wherein said waterbed sheet is dimensioned to cover said upper horizontal sleeping surface of said waterbed mattress and extend only slightly over the sides thereof, the top open edge portion of each of said pockets being at least one of secured to and integral with the outer peripheral edge portion of said waterbed sheet and extending a predetermined distance downwardly therefrom, said predetermined distance being sufficient to at least enable the lower end portion of said pocket with said insert receivably disposed therein to be tucked beneath an edge portion of the bottom horizontal surface of said waterbed mattress and anchored between said bottom horizontal surface of said waterbed mattress and the top surface of the bottom of the waterbed frame.

11. A waterbed sheet and sheet-anchoring insert combination for preventing the waterbed sheet from slipping, bunching up, wrinkling, or the like once placed over the top horizontal sleeping surface of a waterbed mattress, said waterbed mattress also having a bottom horizontal surface which is supported on the bottom portion of a waterbed frame, the waterbed mattress includes sides integrally interconnecting the top and bottom horizontal surfaces, the sides bulging outwardly from the center of the waterbed mattress toward the sides of the waterbed frame which limits the outward bulge when said bed is loaded, said combination comprising:

a sheet of fabric material sized to at least cover the top sleeping surface of a waterbed mattress;

a plurality of pockets each having an upper open portion disposed about the periphery of said sheet, a closed bottom portion depending downwardly therefrom, and a hollow sheath-like pocket portion therebetween; and a plurality of generally curved resilient plastic insert means dimensioned to be operatively received within the hollow sheath-like portion of said pocket for anchoring the closed bottom of the pocket having said insert sheathed therein beneath a lower peripheral edge portion of the waterbed mattress by the weight of the water contained within said waterbed mattress and for removably clamping the remaining portion of the pocket having said insert sheathed therein against the side of said waterbed frame by the outwardly bulging contour of the sides of the waterbed mattress at least when additional external weight is applied to the top horizontal sleeping surface of said waterbed mattress.

12. The combination of claim 11 wherein said pockets are formed individually and fixedly secured to said sheet at predetermined spaced locations thereabout.

13. The combination of claim 11 wherein said pockets are integral with said waterbed sheet.

* * * * *